US006761676B2

(12) United States Patent
Wingate et al.

(10) Patent No.: US 6,761,676 B2
(45) Date of Patent: Jul. 13, 2004

(54) DEVICE FOR CONTROLLING PRINTED PRODUCTS

(75) Inventors: Matthew Jon Wingate, Durham, NH (US); Mark Anthony Wingate, New Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/123,583

(22) Filed: Apr. 16, 2002

(65) Prior Publication Data

US 2003/0045417 A1 Mar. 6, 2003

Related U.S. Application Data

(60) Provisional application No. 60/317,774, filed on Sep. 6, 2001.

(51) Int. Cl.[7] ..... B31B 1/88

(52) U.S. Cl. ..... 493/320; 493/324; 493/340

(58) Field of Search ..... 493/320, 324, 493/340, 227, 223, 224; 270/1.01, 52.21, 52.22

(56) References Cited

U.S. PATENT DOCUMENTS

| | | | | | |
|---|---|---|---|---|---|
| 5,392,700 | A | * | 2/1995 | Kleinhen | 100/7 |
| 5,451,040 | A | * | 9/1995 | Crabtree | 271/10.11 |
| 5,538,242 | A | * | 7/1996 | Doucet | 271/299 |
| 5,688,219 | A | * | 11/1997 | Renard et al. | 493/357 |
| 6,267,366 | B1 | * | 7/2001 | Graushar et al. | 270/1.02 |
| 6,302,392 | B1 | * | 10/2001 | Schaefer et al. | 271/283 |
| 6,394,445 | B1 | * | 5/2002 | d'Agrella et al. | 271/182 |
| 6,464,218 | B2 | * | 10/2002 | Neary et al. | 271/270 |

* cited by examiner

*Primary Examiner*—Eugene Lee Kim
(74) *Attorney, Agent, or Firm*—Davidson, Davidson & Kappel, LLC

(57) ABSTRACT

A tape transport system for printed products comprising a first tape, a pulley supporting the tape, and a lever arm supporting the pulley, the lever arm including a first side rail and a second side rail, the pulley supported rotatably between the first and second side rails to form a narrow mechanism.

16 Claims, 7 Drawing Sheets

DEVICE FOR CONTROLLING PRINTED PRODUCTS

Priority to U.S. Provisional Patent Application No. 60/317,774, filed Sep. 6, 2001 and incorporated by reference herein, is claimed.

BACKGROUND INFORMATION

The present invention relates generally to controlling printed products, for example signatures.

In a folder of a printing press, a web of paper often is folded and then cut, for example using a first set of cutting cylinders to make a first cut, and then a second set of cutting cylinders further downstream to complete the cut to form signatures. Tapes often are used to support the signatures on both sides while the second set of cutting cylinders is finishing the but between the tapes. A delivery device, for example deceleration drum, then can grip the front edge of the signatures through the tapes so as to transfer the signatures to the deceleration drum. A set of grippers that extends through the tapes is typically provided in the delivery device.

The components that grip and transport the printed signatures are generally desired to be as wide as possible to minimize marking an damage to the products as well as to support a variety of product widths.

These gripper components sweep between the tapes. The tapes are supported on pulleys which are supported by lever arms. However, existing lever arms typically are much wider than the pulleys, and thus reduce the space for the grippers that pass between the tapes.

FIG. 1 shows a prior art device with a tape transport mechanism 2 and a signature diverter 4. Diverter flippers 18 of the diverter 4, supported on a pivot center 16, pass between pulleys 15, 115 which support tapes 14, 214 on the left side of FIG. 1. Other tapes are not shown for clarity. The lever arms 12 that support the pulleys 15, 115 are supported on a rod 10.

As shown in FIG. 2A for another prior art device, an adjustable lever arm 12 having an air cylinder for extending the arm length has a side support 11 for pulley 15 which causes the width 118 of the lever arm and pulley combination to be much larger than a tape width 114, for example 2.21 times as large. FIG. 2B shows a side view of the adjustable lever arm 12, while FIG. 2C shows details of the pulley 15 through section A—A in FIG. 2B. FIG. 2D shows a perspective view of the adjustable lever arm 12.

The large ratio between width 118 and width 114 reduces the space S between the lever arms supporting tapes similar to tapes 14, 214 (See FIG. 1) permissible for the parts 218 of the diverter flippers 18 that extend between the tapes.

BRIEF SUMMARY OF THE INVENTION

An object of the present invention is to provide a reduced ratio of the pulley and lever arm width with respect to the tape width.

A further alternate or additional object of the invention is to be able to increase the effective gripper or diverter width.

Another alternate or additional object of the present invention is to provide improved gripping and handling of printed products.

The present invention thus provides a tape transport system for printed products comprising a first tape, a pulley supporting the tape, and a lever arm supporting the pulley, the lever arm including a first side rail and a second side rail, the pulley supported rotatably between the first and second side rails.

"Rail" as defined herein is an elongated thin piece of material.

Preferably a plurality of tapes are provided, each tape supported by a pulley and lever arm with two side rails.

The side rails preferably are thin sheets, for example made of steel.

The present invention also provides a lever support arm for a tape pulley of a folder in a printing press comprising a first side sheet, a second side sheet and a pulley supported between the first side sheet and the second side sheet.

The present invention also provides a method for transporting printed products comprising transporting signatures using a first tape, and passing the first tape over a pulley, the pulley being supported on a lever arm supporting the pulley, the lever arm including a first side rail and a second side rail, the pulley supported rotatably between the two side rails.

The present invention also provide a folder comprising:

a tape transport device having a first tape and a second tape, a first pulley supporting the first tape and a second pulley supporting the second tape, a first lever arm supporting the first pulley, the first lever arm including a first side rail and a second side rail, the first pulley supported rotatably between the first and second side rails; and a printed product transfer device including at least one component passable between the first tape and the second tape.

Preferably, the transfer device is a deceleration drum and the component a gripper.

Preferably, the ratio of a combined width of the first pulley and the first side rail and second side rail at the pulley to that of the tape is less than 2, and most preferably less than 1.2.

Preferably, the second lever arm includes two side rails, the second pulley being supported between the two side rails.

Figure 1:
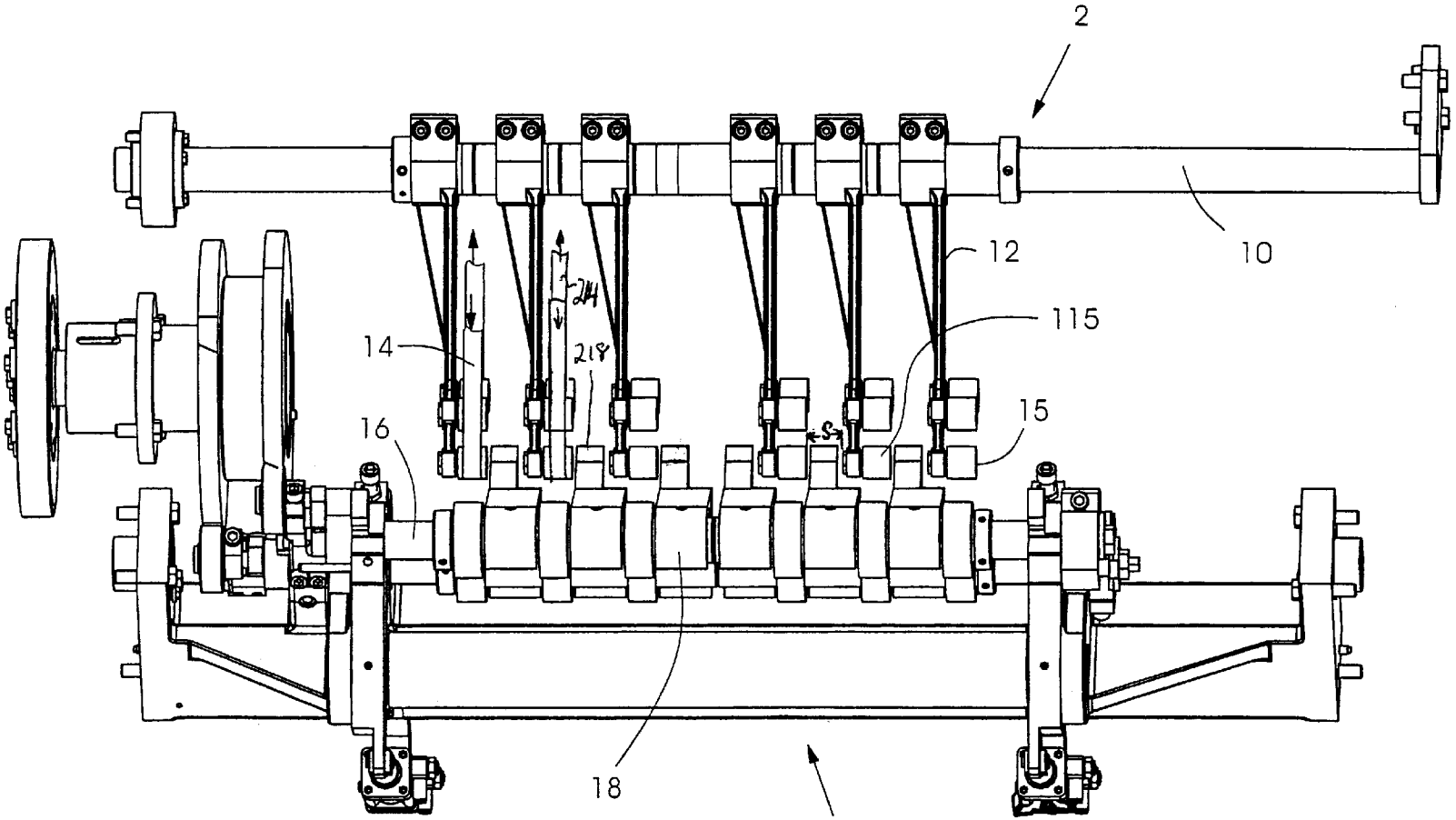
Fig. 1 (Prior Art)
FIGS. 1, 2A, 2B, 2C and 2D show sections of prior art folders.
Figure 2C:
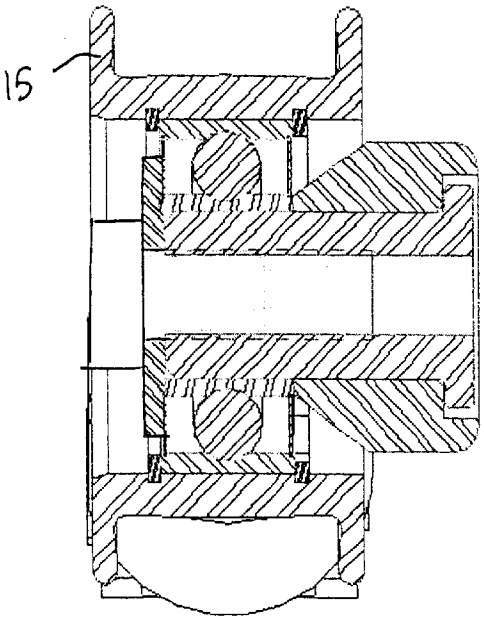
FIG. 2C (PRIOR ART)
Figure 2D:
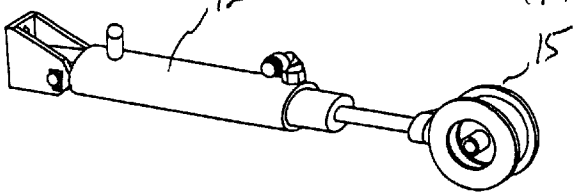
FIG. 2D (PRIOR ART)
Figure 2A:
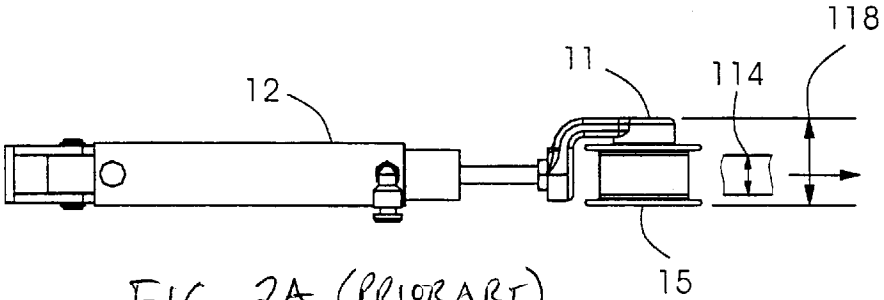
FIG. 2A (PRIOR ART)
Figure 2B:
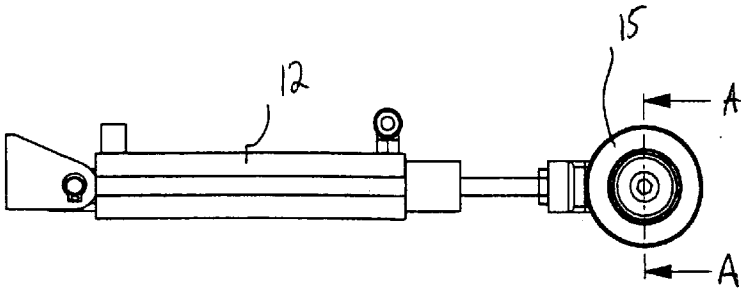
FIG. 2B (PRIOR ART)
Figure 3:
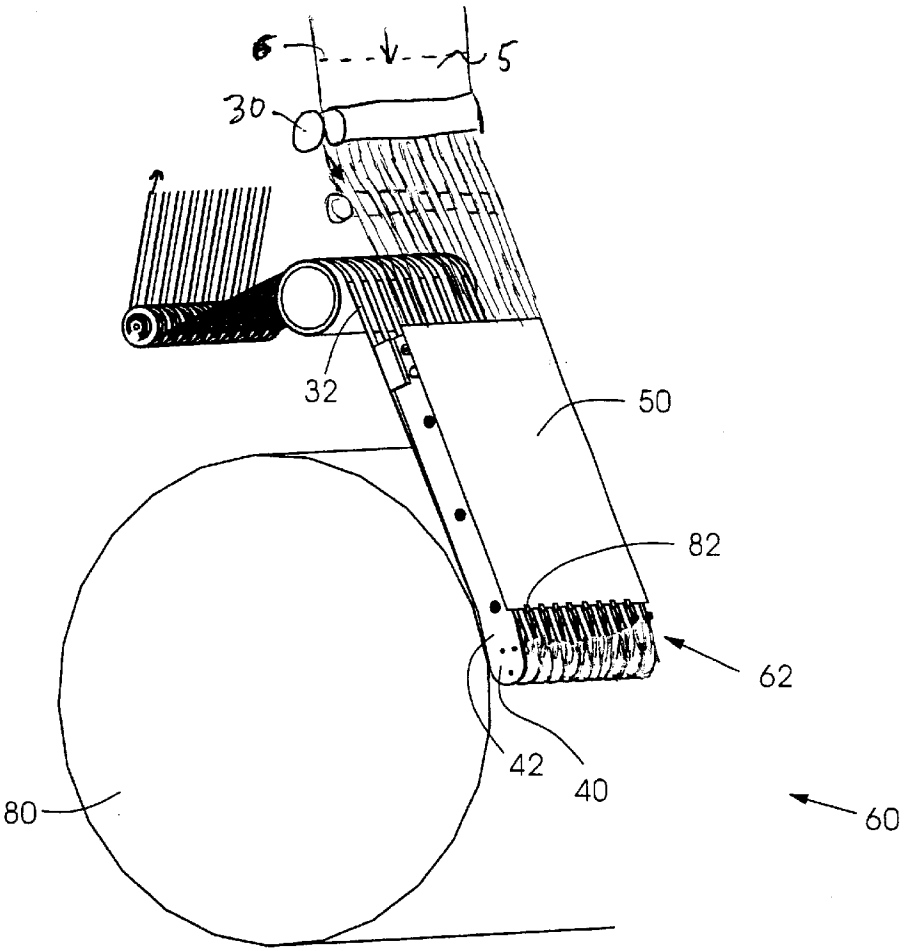
Figure 4:
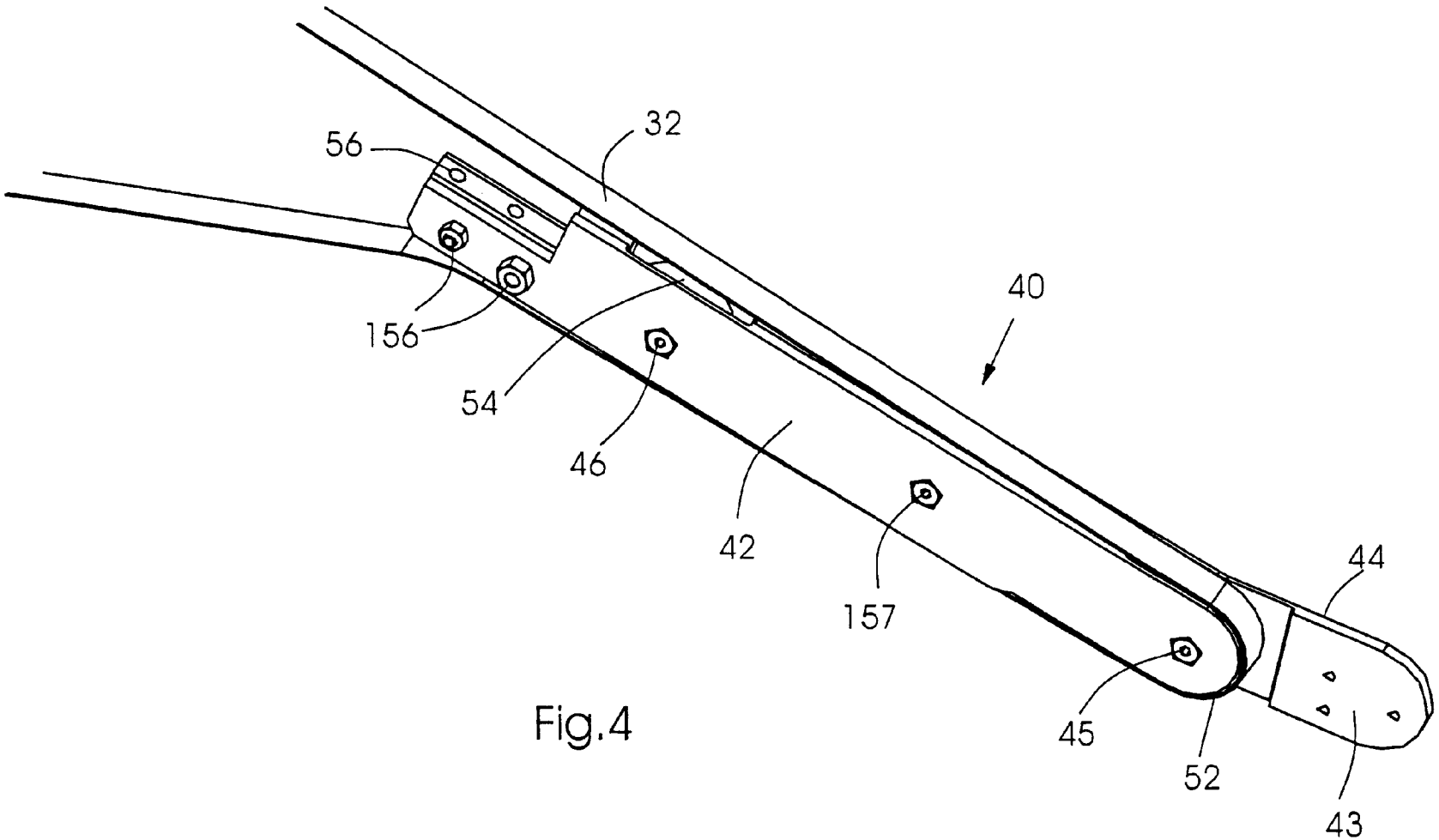
Figure 5:
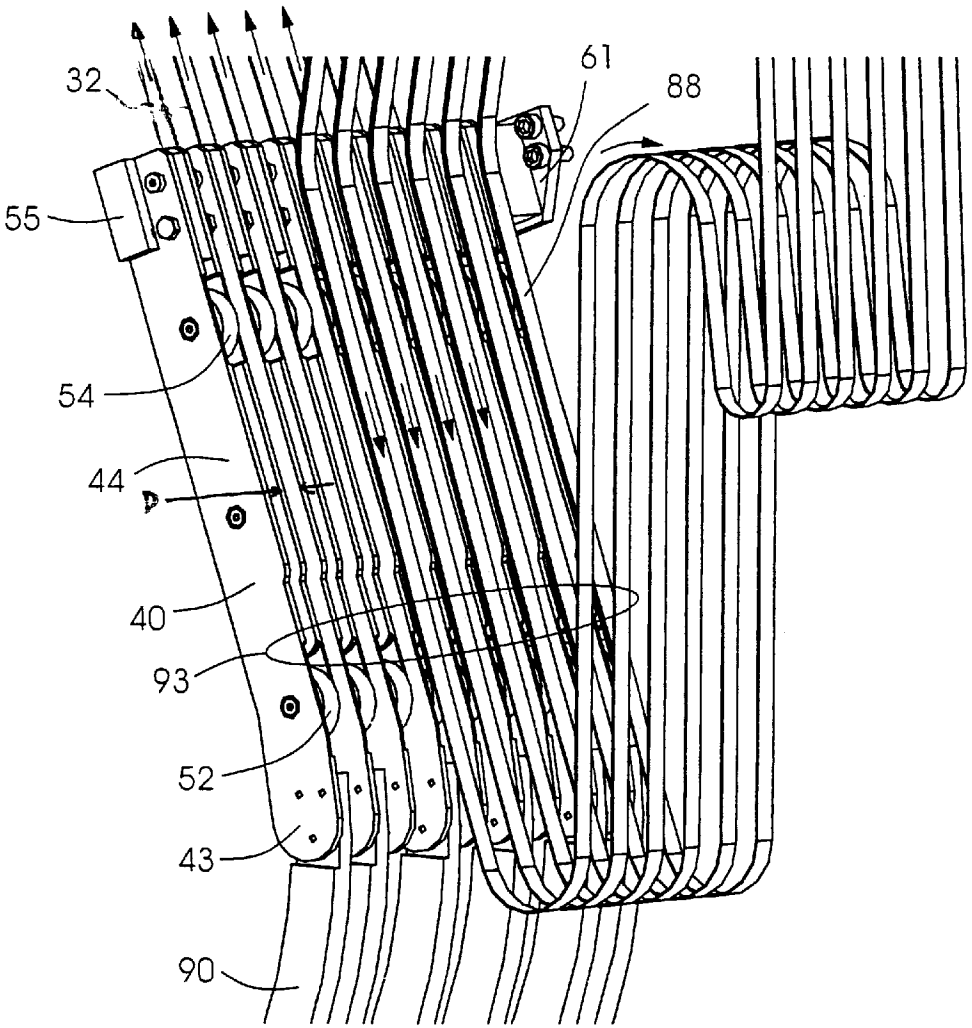
Figure 6:
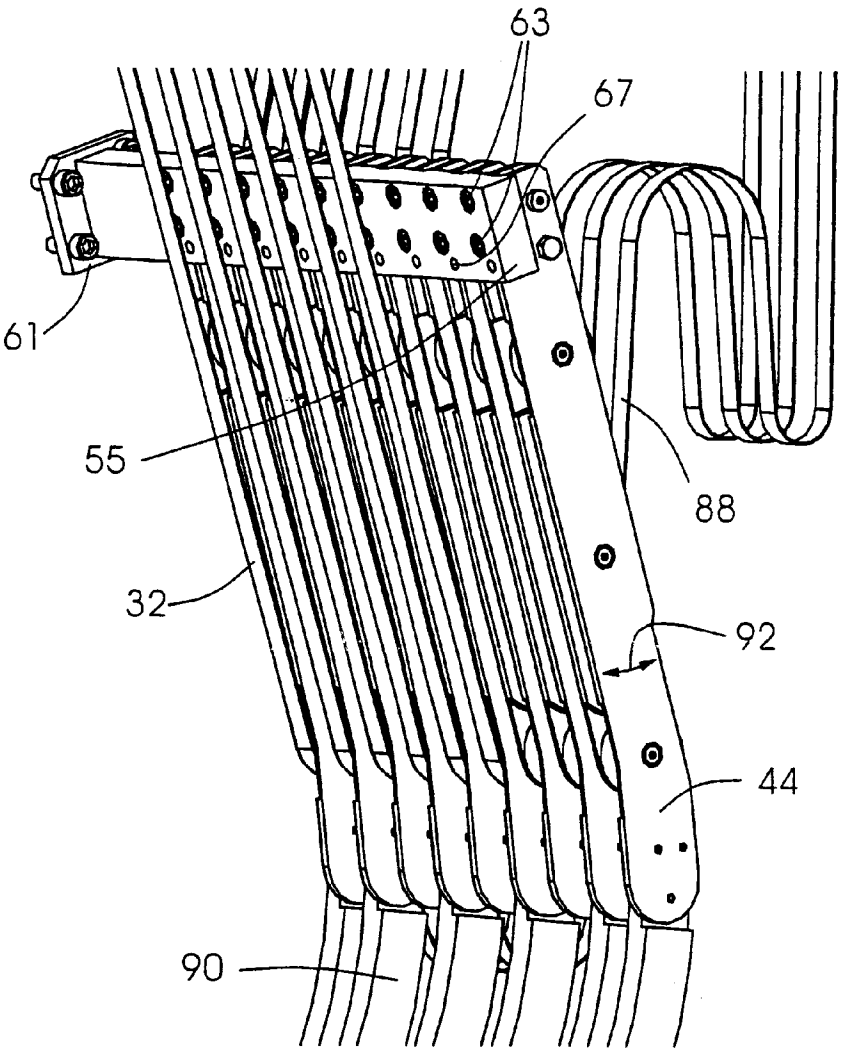
Figure 7D:
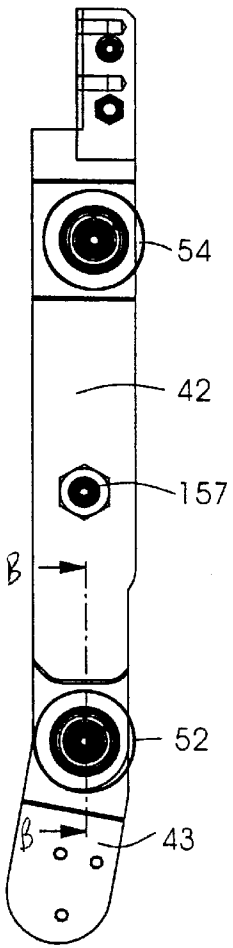
Figure 7C:
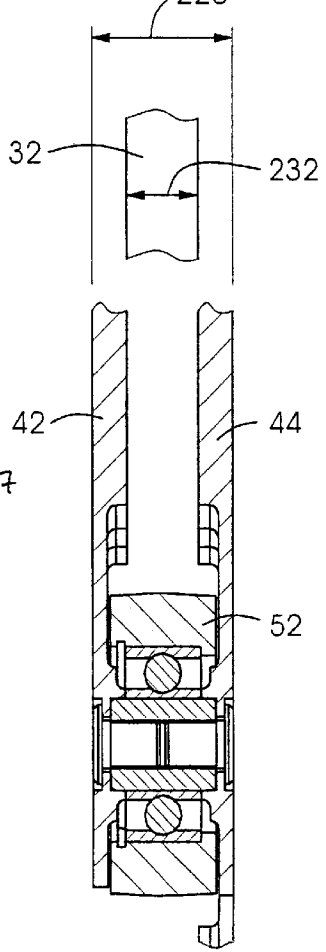
Figure 7B:
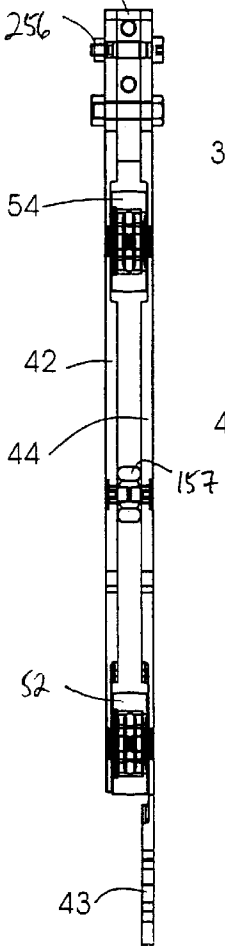
Figure 7A:
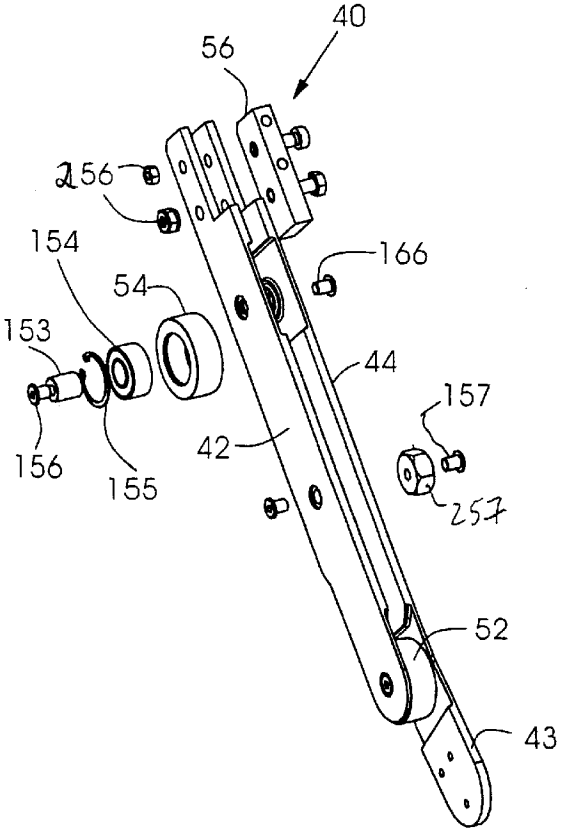

Exemplary embodiments of the present invention are described below by reference to the following drawings, in which:

FIG. 3 shows a simplified view of a folder according to the present invention;

FIG. 4 shows the lever arm of the present invention;

FIG. 5 shows a part of the tape transport device of the present invention from a first view;

FIG. 6 shows a rear view of the tape transport device as shown in FIG. 5;

FIG. 7A shows technical details of the lever arm of the present invention in perspective view;

FIG. 7B shows an end view of the lever arm of the present invention;

FIG. 7C shows a more detailed view of the lever arm in the region of pulley 52 through cross section B—B of FIG. 7D; and FIG. 7D shows a side view of the lever arm.

DETAILED DESCRIPTION

FIG. 3 shows partially a folder 60, which has a cutting cylinders 30, shown schematically, cutting a web 5. Cutting cylinder 30 may be a second set of cutting cylinders with spaced knives, which a plurality of tapes 32 run through on a back side of the web at already cut perforations 6. The cutting cylinder 30 then completes the cut between the perforations 6, so that signatures 50 are formed. Part of a signature is not shown for clarity. Also tapes 88 (FIG. 5) on the front side of web 5 are also not shown in FIG. 3 for clarity.

Folder 60 also includes a tape transport device 62 for signatures and a deceleration drum 80. Tape transport device 62 guides the plurality of tapes 32 (the bottom tapes being shown) that guide signature 50 cut from web 5 along the tapes 32. The tapes 32 are supported by pulleys 52, 54 (FIG. 7B) in lever arm 40, which has a first side rail 42.

As shown in FIG. 4, lever arm 40 has a first side rail 42 and a second side rail 44. Supported between the side rails 42 and 44 are pulleys 54 and 52, having axes of rotation 46, 45, respectively.

A mounting pad 43 can be provided on one of the rails 44, so as to permit alignment of the tape transport device 40 with another device, such as another tape transport device.

An alignment block 56 can be provided to space the rails 42, 44 apart. The pulleys axles also provide spacing. Fasteners 156 and 256 can hold the rails 42, 44 together.

Pulleys 54 and 52 thus are rotatingly supported in the arms 42, 44.

FIG. 5 partially shows a plurality of the lever arms 40 supporting tapes 32, with part of the tapes not shown so that the pulleys 52 and 54 can be viewed. However, it should be understood that the tapes run over pulleys 52 and 54 as shown in FIG. 4.

Opposing tapes 88, shown for clarity spaced apart from tapes 32, contact another side of the signature 50 so that the signatures are held between the tapes. The signatures are transferred to grippers 82 of drum 80 (FIG. 3) at a planar (flat) transfer area 93, with the velocity of the tapes 32 matched to the tangential velocity of the grippers 82. The grippers can act in a space D between the lever arms 40.

Inside guides 90, which can be movable, can attach to mounting pad 43 for additional support. A cantilever support 55 attached to a support 61 can attach all of the tape levers 40.

FIG. 6 shows the cantilever support 55 more clearly, some of tapes 32 not being shown for clarity. Connectors 63 can connect the alignment blocks 56 to the support 55. Set screws 67 can be used to adjust the angularity of each lever arm 40 in direction 92. This can ensure a flat, planar surface 93 (FIG. 5) of the transport device for proper transfer of the signatures.

FIGS. 7A, 7B and 7D show more details of lever arm 40 with side rails 42, 44. Pulley 54, which fits between rails 42, 44 includes a bearing 154, retaining ring 155, shaft 153 and connectors or fasteners 156 and 166. Pulley 52 may be of similar construction. Alignment block 56 can be connected to the rails to space the rails by connectors 256. A fastener 157 with a spacer nut 257 can be provided as well.

As shown in FIG. 7C, a width 220 of the lever arm at the pulley 52 may be such that it is less than twice the width 232 of tape 32. The ratio of width 220 to width 232 advantageously may even be less that 1.5, for example 1.4.

List of Elements

2 tape transport mechanism
4 diverter
5 web
6 perforations
10 rod
11 side support
12 adjustable lever arm/ air cylinder
14 tape
15 pulley
16 pivot center
18 diverter flipper
30 cutting cylinders
32 tapes (lower)
40 lever arm assembly
42 side rail
43 mounting pad
44 side rail
45 rotational axis
46 rotational axis
50 signature
52 pulley
54 pulley
55 support
56 alignment block
60 folder
61 support
62 tape transfer device
63 connectors
67 set screws
80 deceleration drum
82 grippers
88 tapes (upper)
90 guides
92 lever movement direction
93 transfer area
114 tape width
115 pulley
118 width
153 shaft
154 bearing
155 retaining ring
156 fastener
157 fastener
166 connector
214 support tape
218 diverter parts
220 width
232 width
256 connectors
257 spacer nut

What is claimed is:

1. A tape transport system for printed products comprising:

a first tape, a first pulley supporting the tape, an arm supporting the first pulley, the arm including a first side rail and a second side rail, the first pulley supported rotatably between the first and second side rails, a second arm having a third side rail and a fourth side rail, a second tape, a second pulley supported between the third side rail and the fourth side rail, and a movable gripper passable between the arm and the second arm.

2. The tape transport system as recited in claim 1 further comprising an arm support, the arm being a movable lever arm supported at one end by the support.

3. The tape transport system as recited in claim 1 wherein the first and second side rails are side sheets.

4. The tape transport system as recited in claim 1 further comprising an additional pulley between the first side rail and the second side rail.

5. The tape transport system as recited in claim 1 further comprising an alignment block between the first side rail and the second side rail.

6. A folder comprising:

a tape transport device having a first tape and a second tape, a first pulley supporting the first tape and a second pulley supporting the second tape, a first arm supporting the first pulley, the first arm including a first side rail and a second side rail, the first pulley supported rotatably between the first and second side rails, a second arm supporting the second pulley and the second tape, the second arm having a third side rail and a fourth side rail, the second pulley being supported between the third side rail and fourth side rail; and a printed product transfer device including at least one component passable between the first tape and the second tape.

7. The folder as recited in claim 6 wherein the transfer device is a deceleration drum and the component a gripper.

8. The folder as recited in claim 6 wherein a ratio of a combined width of the first pulley and the first side rail and second side rail at the pulley to that of a width of the tape is less than 2.

9. The folder as recited in claim 8 wherein the ratio is less than 1.2.

10. The folder as recited in claim 6 further comprising an arm support, the first arm being a movable lever arm supported at one end by the support.

11. The folder as recited in claim 6 further comprising an additional pulley between the first side rail and the second side rail.

12. The folder as recited in claim 6 further comprising an alignment block between the first side rail and the second side rail.

13. The folder as recited in claim 6 further comprising a cutting device.

14. The folder as recited in claim 13 wherein the first and second tapes pass through the cutting device.

15. A tape transport system for printed products comprising:

a first tape, a first pulley supporting the tape, an arm supporting the pulley, the arm including a first side rail and a second side rail, the first pulley supported rotatably between the first and second side rails, a second arm having a third side rail and a fourth side rail, a second tape, a second pulley supported between the third side rail and the fourth side rail, and a movable gripper passable between the arm and the second arm, the arm and the second arm being cantilevered.

16. The tape transport system as recited in claim 1 wherein the pulley has a width similar to a distance between the first side rail and the second side rail.

* * * * *